United States Patent [19]

Hite et al.

[11] Patent Number: 5,005,397

[45] Date of Patent: Apr. 9, 1991

[54] METHOD FOR PROVIDING PROGRESSIVE FORMERS WITH QUICK-CHANGE TOOLING

[75] Inventors: William H. Hite; Gene E. Allebach, both of Tiffin, Ohio

[73] Assignee: The National Machinery Company, Tiffin, Ohio

[21] Appl. No.: 434,301

[22] Filed: Nov. 13, 1989

Related U.S. Application Data

[62] Division of Ser. No. 230,327, Aug. 9, 1988, Pat. No. 4,898,017.

[51] Int. Cl.[5] ..... B21J 13/08; B21J 13/02

[52] U.S. Cl. ..... 72/405

[58] Field of Search ..... 72/405, 356; 10/11 T, 10/12 T, 12.5, 15, 72 T, 76 T

[56] References Cited

U.S. PATENT DOCUMENTS

| | | | |
|---|---|---|---|
| 353,584 | 11/1896 | Philips | 10/11 T |
| 1,963,572 | 6/1934 | Wilcox | 10/12 T |
| 1,977,161 | 10/1934 | Wilcox | 10/12 T |
| 2,205,507 | 6/1940 | Wilcox | 10/12.5 |
| 3,165,766 | 1/1965 | Wisebaker | 10/12 T |
| 3,559,446 | 2/1971 | Dom | 72/405 |
| 4,044,588 | 8/1977 | Haines | 10/11 T |
| 4,387,502 | 6/1983 | Dom . | |
| 4,631,950 | 12/1986 | Hay et al. | 72/405 |

*Primary Examiner*—Daniel C. Crane

*Attorney, Agent, or Firm*—Pearne, Gordon, McCoy & Granger

[57] ABSTRACT

A progressive former having quick-change tooling provides tooling supports with means for adjusting the tools. The tooling is mounted so that the tooling and the structure for adjusting the tooling can be removed as units without loss of the fine-tuning of the adjustments and so that reinstallation does not require readjustment of the tooling. A transfer also provides adjustable cams for opening and closing gripper fingers which transport workpieces from one work station to the next. The adjustable cams are removable with the dies as units and can be reinstalled without further fine-tune adjustment. With the invention, entire tool sets can be changed in a very short time to eliminate loss of production capacity of the machine. Similar sized machines are provided with a fixed spacing between the locating surfaces for the stationary dies and the reciprocating tools so that tool sets having adjustments fine-tuned in one machine can be installed in a similar machine without further retuning of the adjustments.

4 Claims, 12 Drawing Sheets

METHOD FOR PROVIDING PROGRESSIVE FORMERS WITH QUICK-CHANGE TOOLING

This is a division of application Ser. No. 07/230,327, filed Aug. 9, 1988, now U.S. Pat. No. 4,898,017.

BACKGROUND OF THE INVENTION

This invention relates generally to progressive formers, and more particularly to a novel and improved progressive former structure permitting low-cost manufacturing and rapid tool change.

PRIOR ART

Progressive formers or progressive forging machines usually provide a die breast forming part of or mounted on the bed frame of the machine. A slide is also mounted on the bed frame for reciprocation toward and away from the die breast. A suitable drive is provided to reciprocate the slide. Such drive may, for example, be a crank and pitman drive or a toggle drive. Dies mounted in the die breast cooperate with tools carried by the slide to provide work stations at which workpieces are progressively formed to required final shape.

Such machines also provide transfers which progressively transport the workpieces to each work station, where successive forming of the workpiece occurs. Further, many such machines include a cutter which cuts workpieces from the end of rod or wire stock. Such machines may, for example, provide two or more work stations.

Progressive formers are generally designated by the diameter of the stock which is forged and the number of work stations provided. For example, machines for forming one-half inch stock are generally referred to as one-half inch machines even though they may provide from two to five work stations or more. Further, such machines may be cold formers which work unheated stock, warm formers which are supplied with stock heated to an elevated temperature below the recrystallization temperature of the stock, or hot formers which work stock heated to a temperature above the recrystallization temperature of the stock.

In the past, many of the various component parts and subassemblies of the machine have been unique to both the size of the machine and also to the number of work stations of the particular machine of a given size. Consequently, machine costs have been high. Also, the lead time required between the time the machine is ordered and its delivery has been long.

Progressive formers are high-production machines and are often used to produce parts that do not require the full output potential of the machine. Therefore, the practice in many cases is to produce a number of different parts in sequential machine runs. Changing the machine for producing different work-pieces normally requires the changing of the entire tooling set and readjustment or modification of some of the machine accessories.

In the past, changeovers during which the tooling is changed to provide for the production of a different workpiece have been very time-consuming and resulted in substantial loss of the potential machine production. For example, when a tooling change is made within the machine itself, it is common for the changeover to take between eight and sixteen hours. In fact, such changeovers often take much longer times.

In order to reduce the changeover time, some machines have been structured to permit the removal of the die breast and the dies contained therein as a unit, and to remove the slide-supported tools as a unit. An example of such a machine is described in U.S. Pat. No. 3,559,446. Substantial reductions in the changeover time are achieved with such systems, in which the tools are initially set up in separate fixtures so that a substantial portion of the setup work is completed before the assembled tooling is installed in the machine. However, because such fixtures cannot duplicate the actual running conditions of the machine, it is still necessary to fine-tune the adjustment of the tooling within the machine itself. Consequently, even with such systems, a tooling changeover usually requires several hours, and results in substantial loss of the machine's potential protection capacity. Also, such fine-tuning of the adjustment of the tooling requires highly skilled personnel.

It is also known to provide an automated system for removing tooling from a machine and installing substitute tooling therein. An example of such a system is illustrated in U.S. Pat. No. 4,387,502. Here again, even though the system is automated, it is necessary to fine-tune the adjustment of the tooling and substantial periods of time are required when a complete tool change is made.

It is also known in some smaller machines to provide a tool pack which includes both the stationary dies and the reciprocating tools along with a transfer system. Such a system is described in U.S. Pat. No. 4,631,950. Because all of the tooling in the transfer system can be removed as a unit and can be replaced by another fully assembled unit, the time required to change over such a tool pack machine is still further reduced. However, such complete tool pack systems are not economically practical for larger machines.

SUMMARY OF THE INVENTION

There are a number of important aspects to this invention. In accordance with one important aspect, a novel and improved tooling system is provided which permits quick removal of an entire tool set from a progressive former without the loss of the fine-tuning adjustment, so that the entire tooling set can be subsequently reinstalled and be run without requiring time-consuming readjustment of the machine tooling. Consequently, a complete tool changeover can be made quickly, usually in less than about twenty minutes. Such tooling system is economically feasible for use even in larger machines.

In accordance with another important aspect of this invention, a novel and improved header slide tooling assembly is provided. Such assembly includes all the tool positioning adjustment structure. Consequently, such tool assembly can be removed from a machine and subsequently replaced as a unit without requiring the retuning or readjustment of the tooling.

In accordance with another important aspect of this invention, a novel and improved die breast assembly is provided in which the die breast and the dies mounted thereon can be removed and subsequently reinstalled as a unit without requiring any readjustment of the assembly.

Further, a novel and improved structure is provided in which the transfer slide and transfer camshaft can also be removed with the die breast and subsequently reinstalled without requiring readjustment. Also, the cutter is mounted on the die breast and is removable with the die breast. However, the cutter is also separately removable when only the cutter needs to be serviced.

Because the tooling is removable and installable as two separate subassemblies, the initial setup of the entire set of tools can be performed on a separate jig and, thereafter, the tooling can be quickly installed in the machine. In the initial installation of the tooling, fine-tuning adjustment must be performed within the machine. However, since the adjusting structure for fine-tuning is part of the removable assembly, such fined-tuned adjustment is not lost when the tool set is removed. Consequently, when the tooling is replaced, it does not require additional fine-tuning adjustment and the changeover can be performed very quickly.

In accordance with another important aspect of this invention, many of the machine subassemblies are standardized and modularized so that machines having different numbers of work stations include a maximum number of identical components. Therefore, it is economically practical to produce many of the component parts and subassemblies for inventory using economical production runs. Then, when a machine must be produced of a given size having a given number of work stations, the appropriate number of similar modules or subassemblies are installed to provide the completed machine.

For example, the transfer of the illustrated embodiment includes a drive system and two or more individual operating modules, with one module provided for each work station. When a two-station machine is required, two modules are assembled with a standard drive to provide the transfer. When a greater number of work stations are required, for example, to produce a five-station machine, five similar modules are assembled with a standard drive to provide the required transfer system.

These and other aspects of this invention are illustrated in the accompanying drawings, and are more fully described in the following specification.

DETAILED DESCRIPTION OF THE DRAWINGS

Figure 1:
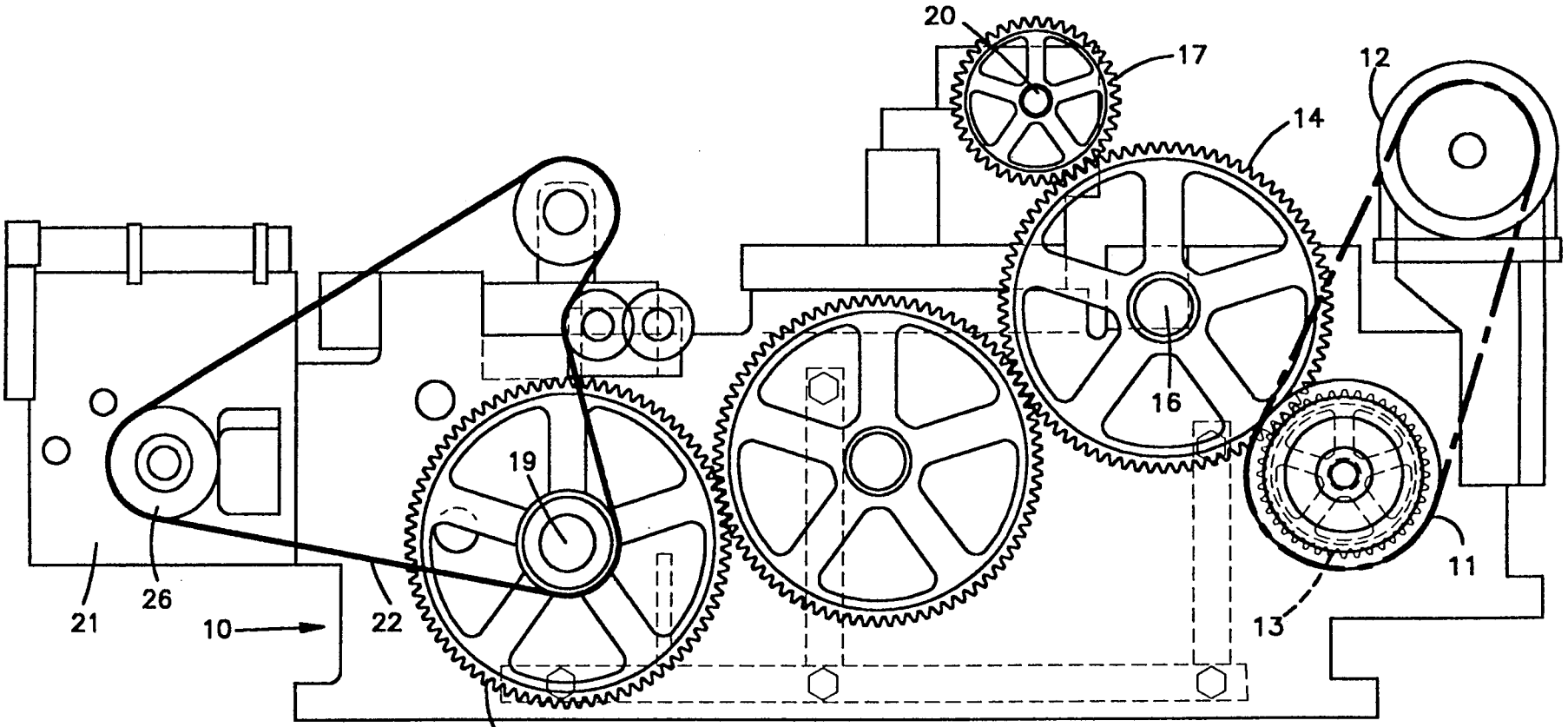
FIG. 1 is a side elevation of a progressive forging machine incorporating this invention.

FIG. 1 is a side elevation of an overall machine incorporating this invention. Aspects of this machine other than the aspects of the machine specifically disclosed and claimed in this application are disclosed in the co-pending application Ser. No. 190,174, filed May 4, 1988 now U.S. Pat. No. 4,910,993 (assigned to the assignee of the present invention) and reference should be made to that application and any patent issuing therefrom for a description of many of the structural components and mode of operation of the overall machine. Further, such application is incorporated herein by reference in its entirety to provide additional disclosure of the overall machine and other aspects and advantages of the machine.

The machine includes a frame assembly 10. Journaled on the frame 10 is a clutch and brake assembly 11 driven by a motor 12. The clutch and brake assembly 11 provides a drive gear 13 which connects with and drives a gear train for powering the various component systems of the machine in timed relationship. The gear train includes a gear 14 on the main crankshaft 16 of the machine, a gear 17 on the camshaft 20 of the timed kickout system, and a gear 18 on the knockout camshaft 19. It also connects with a chain drive 22 which drives a transfer sprocket 24 and a stock feed sprocket 26. All of the systems are rotated through one revolution each time the crankshaft rotates through one revolution except the timed kickout camshaft 20, which rotates through two revolutions. This drive produces timed operation of the various components of the machine.

Figure 2:
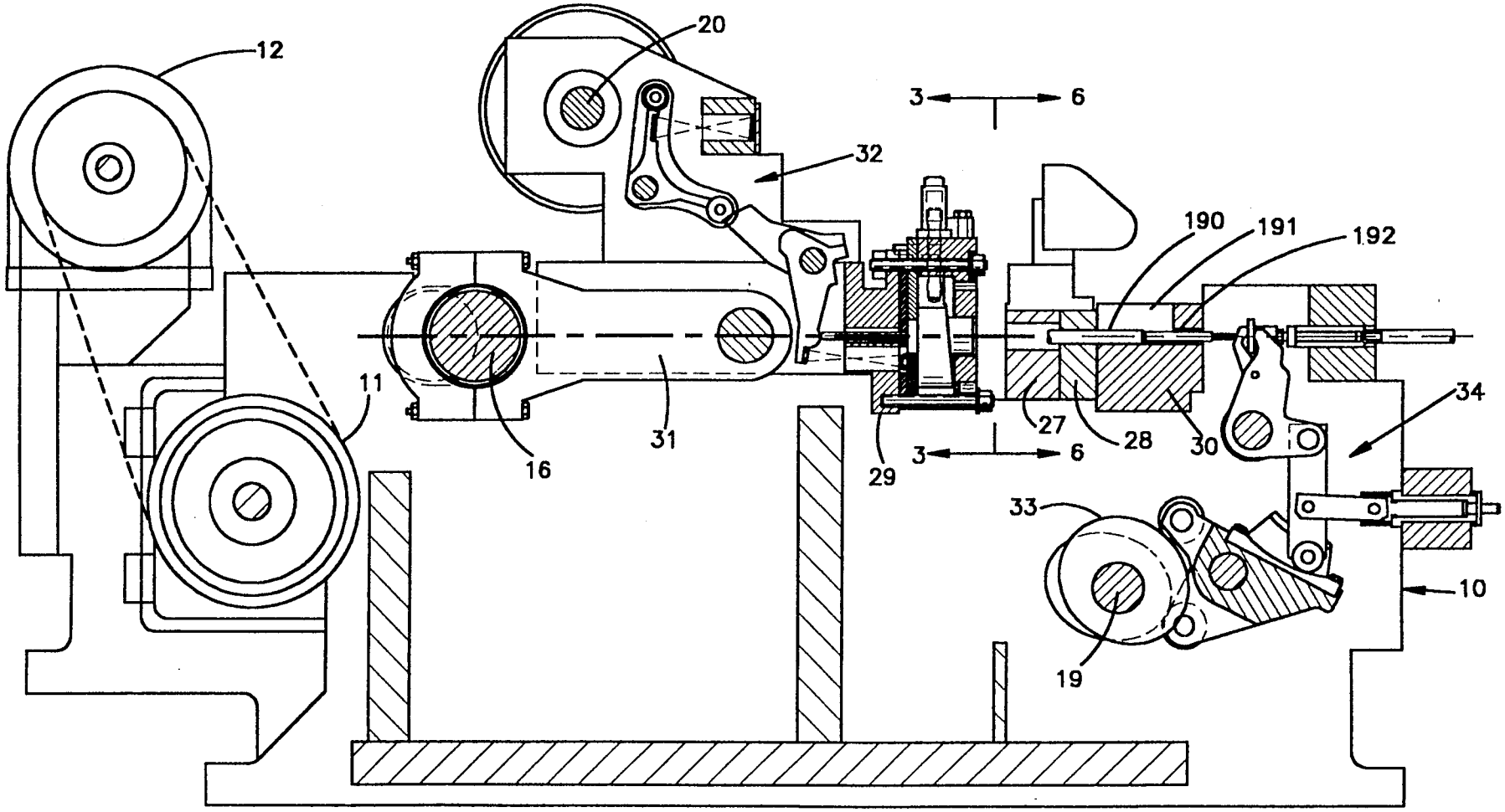
FIG. 2 is a vertical cross section of the machine illustrated in FIG. 1, with parts removed for purposes of illustration.

Referring now to FIG. 2, the machine provides a die breast 27 removably mounted on the frame 10, and in which stationary dies are mounted. Positioned immediately behind and secured to the die breast 27 is a face plate 28 through which the forces on the dies contained within the die breast 27 are transmitted to the breast plate 30 of the frame assembly 10.

Mounted on the frame is a reciprocating slide 29 supported for reciprocating, straight-line movement toward and away from the die breast 27. In this illustrated machine, the slide 29 is reciprocated by a pitman 31 which is connected between the slide 29 and the crankshaft 16 so that rotation of the crankshaft through one full revolution moves the slide 29 back and forth between its forward dead center position illustrated in FIG. 2 and its back dead center position spaced back from the die breast. Cams (not illustrated) mounted on a camshaft 20 operate a linkage 32 for ejecting workpieces from tooling carried by the slide 29. Similarly, cams 33 mounted on the camshaft 19 drive a linkage 34 which operates to eject the workpieces from the dies carried by the die breast 27. Reference should be made to the copending application cited above for a more detailed description of the structure and mode of operation of the linkage 32 and 34.

With this invention, similar machines are produced having a constant predetermined spacing between the face of the slide 29 and the face of the breast plate 30 so that sets of tooling fine-tuned in one machine can be subsequently installed in a similar machine without requiring further fine-tuning.

Figure 12:
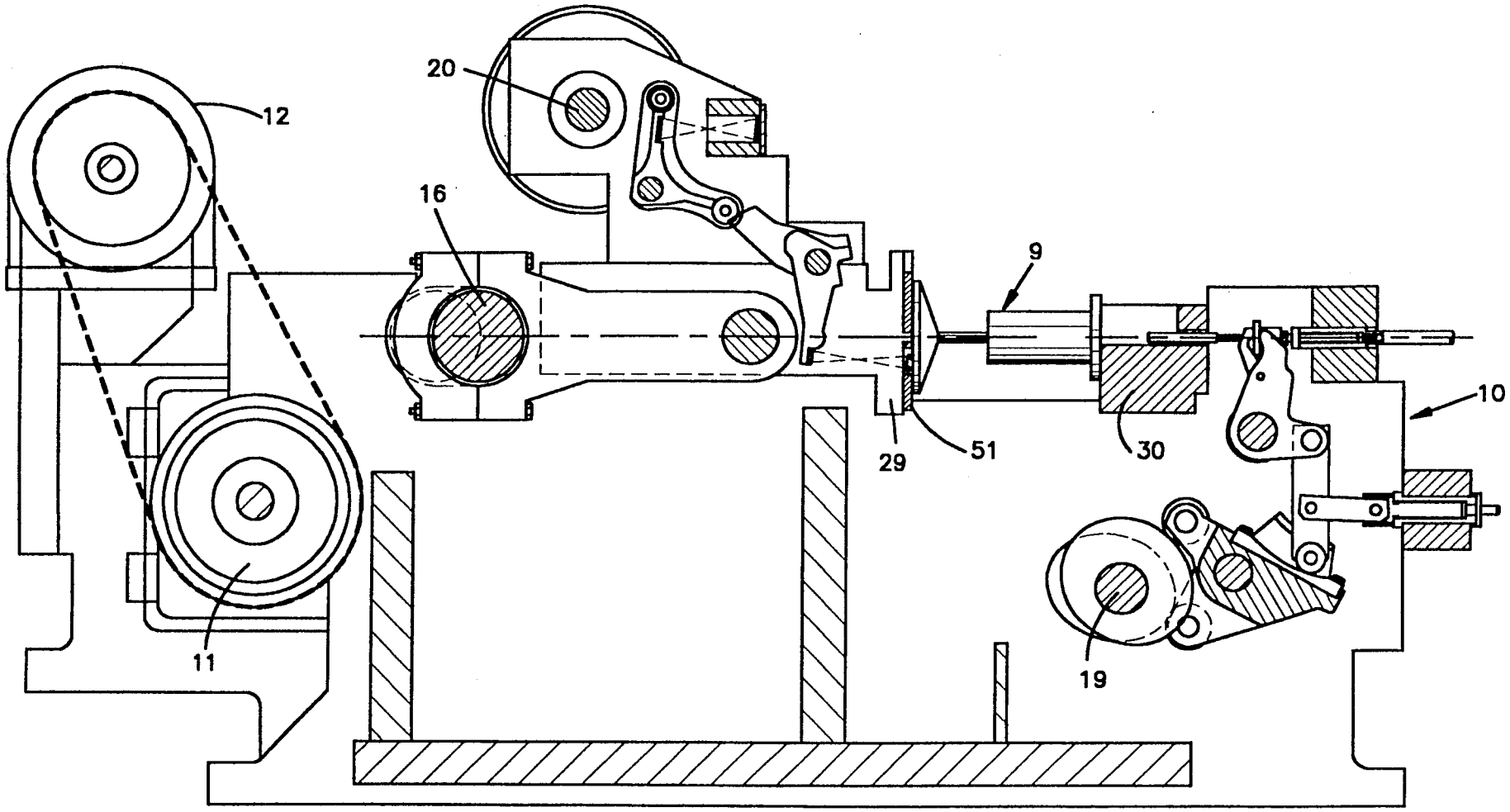
FIG. 12 illustrates a loading fixture used to establish a constant, uniform, predetermined spacing between the tooling supporting surfaces of all machines of a given size having a given number of work stations.

Such constant spacing is accomplished by positioning a jacking fixture 9 (illustrated in FIG. 12) between a gage plate 51 and the breast plate 30 of an assembled machine to load the bearings and take up all clearances in the system. The spacing between the face of the gage plate 51 and the face of the breast plate 30 is then measured to establish the deviation from the desired predetermined spacing.

The fixture 9 is then removed and the gage plate 51 is resized to establish the desired uniform predetermined spacing in all machines of a given size class. Similarly, the relative positions of the locating plate 48 and check plate 49 with respect to the locating surfaces for the die breast are accurately maintained from one machine to another of a given size and a given number of work stations. When groups of machines are manufactured in this way, it is possible to install complete tool sets having fine-tuned adjustments in a similar but different machine without requiring further fine-tuning of the tooling.

THE TOOLING CARRIED BY THE SLIDE

Figure 3:
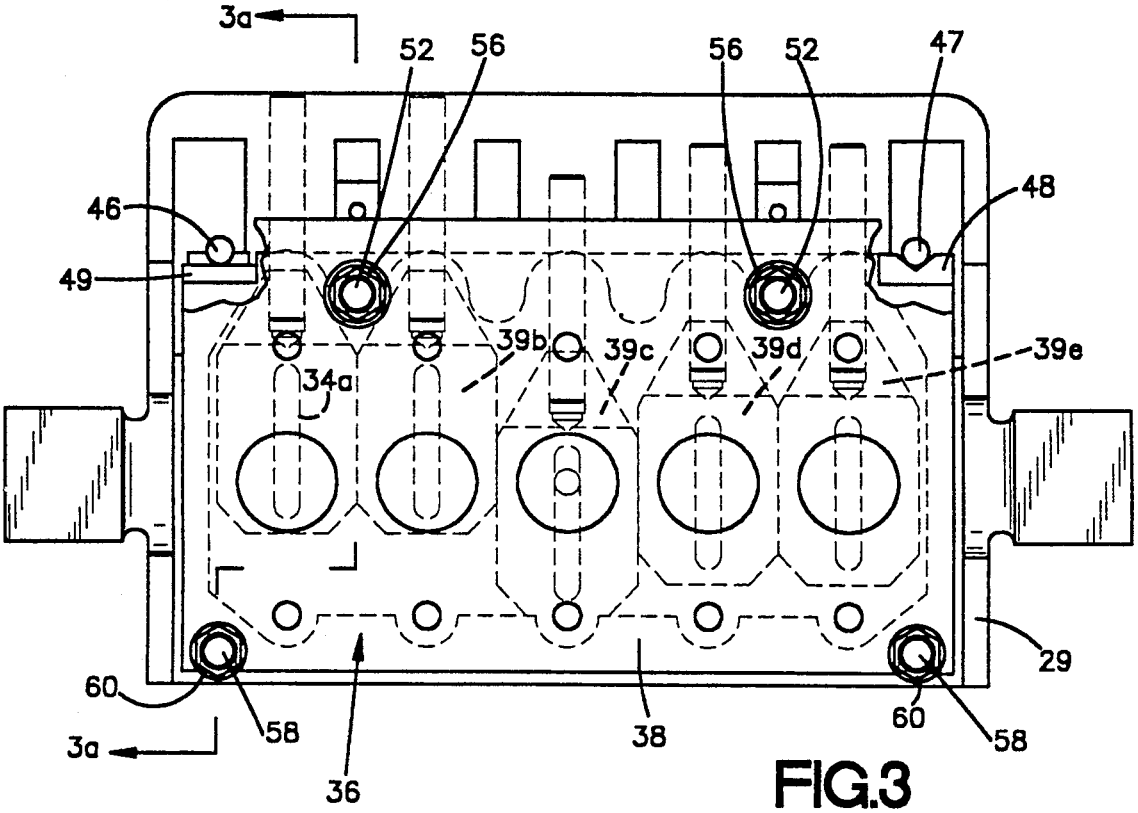
FIG. 3 is a fragmentary view taken generally along line 3—3 of FIG. 2, illustrating the tooling support assembly removably mounted on the slide.
Figure 3A:
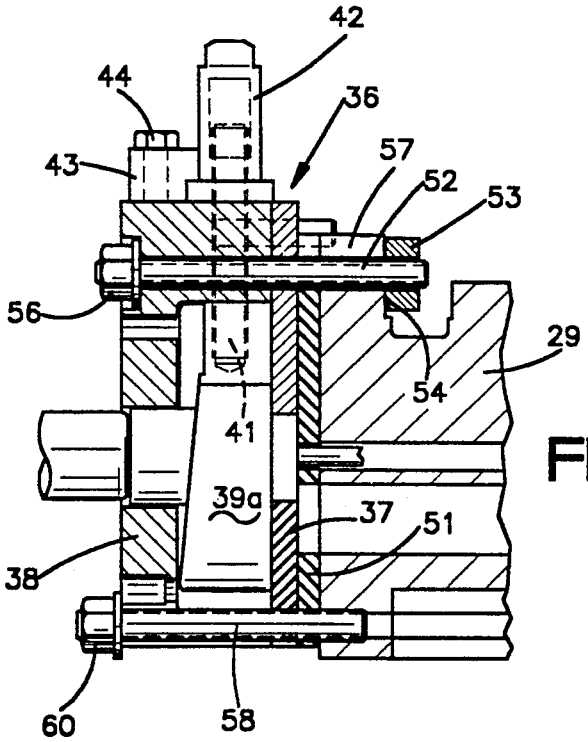
FIG. 3*a* is a fragmentary section taken along line 3*a*—3*a* of FIG. 3, illustrating the tooling support assembly which includes an adjustable backup wedge.

Referring now to FIGS. 3 and 3*a*, a tool support assembly 36 is removably mounted against a face of the gage plate 51 mounted on the slide 29. The illustrated embodiment of this invention is a five-station progressive former in which workpieces are progressively formed at each work station to produce the desired final part. However, the present invention may be incorporated in machines having a lesser or greater number of work stations.

Since there are five work stations in the illustrated machine, the tool support assembly 36 is structured to support five separate horizontally aligned tools, as discussed in greater detail below. The tool support assembly includes a backup or pressure plate 37 which extends entirely across the back of the support assembly 36, and a main body plate 38. Positioned between the plates 37 and 38 are a plurality of vertically adjustable wedges 39*a* through 39*e*, with one wedge provided for each of the work stations of the machine. The wedges adjust the position of the associated tools in a direction aligned with the direction of reciprocation of the slide.

The wedges are individually adjustable in a vertical direction by a screw 41 (best illustrated in FIG. 5), mounted in the upper end of the associated wedge 39. Threaded onto the upper end of each screw is a tube nut 42 which is rotated to adjust the position of the associated wedge 39. The wedges 39 are adjustable between an uppermost position of adjustment illustrated in FIG. 3 with respect to the wedges 39*a* and 39*b*, and a lower extreme position illustrated in FIG. 3 by the wedge 39*c*. In FIG. 3, the vertical positions of the two wedges 39*d* and 39*e* are intermediate between the two extremes of possible positions of adjustment.

A toe clamp 43 and bolt 44 are provided for each nut 42, and when tightened lock the associated nut 42 in its adjusted position so that the vertical adjusted position of the associated wedge is maintained.

The entire tool support assembly 36, along with the tools mounted thereon, is easily removed or reinstalled on the slide 29 as a unit without disturbing the adjustment of the wedges 39 or the other adjustments of the tools discussed below. The precise positioning of the tool support assembly 36 is provided by two locating pins 46 and 47, which are mounted on the assembly 36 and project from the rearward surface thereof. When mounted on the slide, the locating pin 47 rests within a notch accurately produced in a locating plate 48 and the locating pin 46 rests upon the flat upper surface of a check plate 49. The locating pin 47, in cooperation with the notch formed in the locating plate 48, determines the vertical position of the right side of the assembly, as viewed in FIG. 3, and also the horizontal position of the entire assembly. The locating pin 46 and check plate 49 determine only the vertical position of the left side of the assembly 36.

These locating pins and plates are very accurately formed so that when the support assembly is installed upon a slide 29, it is precisely positioned with respect to the slide, the bed, and the die breast both in the vertical and horizontal directions. The front-to-back location of the assembly in the direction of slide reciprocation is precisely determined by the engagement between the backup plate 37 and a gage plate 51 permanently secured to the forward face of the slide 29.

A simple clamping structure is provided to releasably clamp the assembly 36 against the gage plate 51. This clamping structure includes a pair of tie bolts 52 which extend through mating passages in the tool support assembly and are anchored at their rearward end in a clamp plate 53, which engages a rearwardly facing surface 54 on the slide 29. Nuts 56 on the tie bolts, when tightened, operate to clamp the upper portion of the assembly 36 against the gage plate 51. When the nuts 56 are loosened, the tie bolts can be raised up with respect to the slide through vertically open notches 57 formed in the slide 29 and the gage plate 51.

The lower portion of the assembly 36 is clamped against the gage plate by a pair of stud bolts 58 which are mounted on the slide 29 and extend through downwardly open notches formed in the body plate 38 and the pressure plate 37. Here again, nuts 60 are threaded onto the stud bolts 58 and, when tightened, operate to clamp the lower portion of the assembly against the gage plate 51.

In order to remove the slide tool assembly 36, it is merely necessary to loosen the nuts 56 and 60 and lift the entire assembly vertically up out of the machine. Reinstallation is accomplished by merely lowering the assembly down along the face of the slide until the two locating pins support the assembly in the precise desired position and the four nuts 56 and 60 are then tightened to complete the installation.

Figure 5:
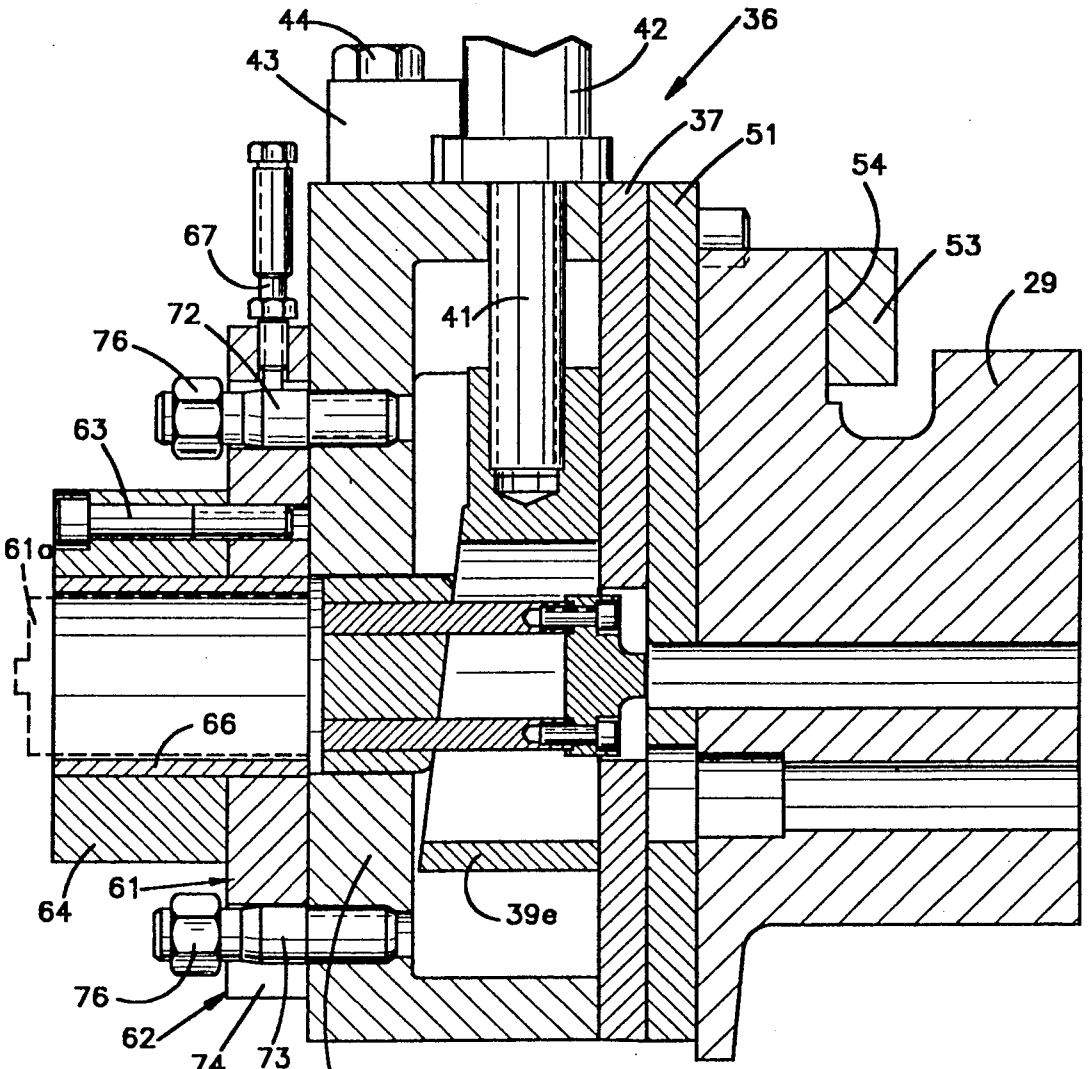
FIG. 5 is a fragmentary section taken along line 5—5 of FIG. 4.
Figure 4:
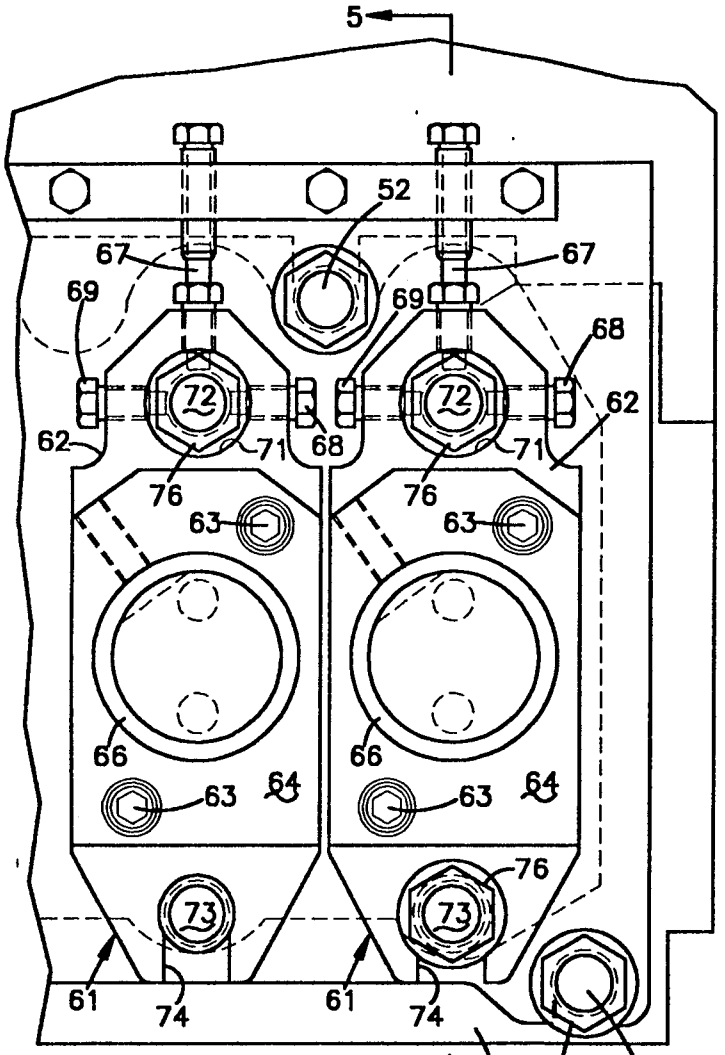
FIG. 4 is an enlarged, fragmentary view, illustrating the structure for adjusting the lateral position of the tool holders relative to the tool support assembly.

Mounted on the forward face of the body plate 38 at each of the die stations is a tool holder assembly 61, each of which is adapted to support the reciprocating tools 61*a* of the associated die station. In FIGS. 4 and 5, the tooling per se is not illustrated in detail, since the tooling provided at each work station is specifically structured for the particular operation to be performed on the workpiece at such station, and will vary from one station to another or from one tool set to another.

Each tool holder assembly includes a tool holder plate 62 on which is mounted, by bolts 63, a tool collar 64. A tool sleeve 66 extends through the collar 64 and the plate 62, and is sized to closely fit and support the periphery of the tool at the associated work station.

The vertical and lateral positions of each plate 62 is determined by an adjusting system including a vertically extending adjusting screw 67 threaded into a vertical bore in the tool holder plate 62 and opposed, horizontally extending adjusting screws 68 and 69, also threaded into the tool holder plate 62. Each of the adjusting screws 67, 68 and 69 extends at its inner end into an enlarged opening 71 formed in the plate 62 through which a stud bolt 72 extends with substantial clearance.

A second stud bolt 73 extends through a downwardly open notch 74 which is sized to closely fit the stud bolt 73 so as to positively establish the lateral location of the tool holder plate at its lower extremity while allowing vertical adjusting movement therebetween.

The inner ends of the three adjusting screws 67, 68, and 69 engage the stud bolt 72 and permit adjustment of the position of the upper end of the tool holder plate 62 in both the vertical and horizontal directions. With this structure, each of the tool holder plates can be adjusted to a precise position in the vertical direction and in a lateral, horizontal direction relative to the body plate. Once adjustment is completed, the nuts 76 on the stud bolts are tightened to maintain the adjustment. A somewhat similar tool adjusting structure is described in U.S. Pat. No. 3,559,446. However, such patent does not disclose a structure in which the adjusted wedge is removed with the tooling, so fine-tuning of the tools is required each time the tools are installed.

With this structure, the wedge 39 provides precise adjustment in a direction aligned with the movement of the slide while the three screws 67 through 69 permit precise adjustment in the other two directions perpendicular to the direction of adjustment provided by the wedge 39.

Normally, the entire tool assembly is set up in a separate jig prior to its initial installation in the machine. However, since a jig normally cannot duplicate load conditions which occur during the operation of the machine, the adjustment of the various tools carried by the slide must be fine-tuned within the machine itself. With the present invention, however, this fine tuning is not altered when the entire tool support assembly 36 is removed from the machine. Therefore, the entire tool assembly can be reinstalled on the machine and the machine, in most instances, can be operated without additional adjustment of the tooling after the reinstallation. Further, since the locating pins 46 and 47 precisely position the tool support assembly with respect to the slide, proper registration of the tools with respect to the dies on the die breast is automatically achieved. This greatly reduces the time required for tool changeover, and permits greater utilization of the production capacity of the machine.

THE REMOVABLE DIE BREAST AND TRANSFER

In accordance with this invention, the die breast and transfer system can also be removed and subsequently reinstalled without requiring any readjustment of these component systems of the machine.

Figure 6:
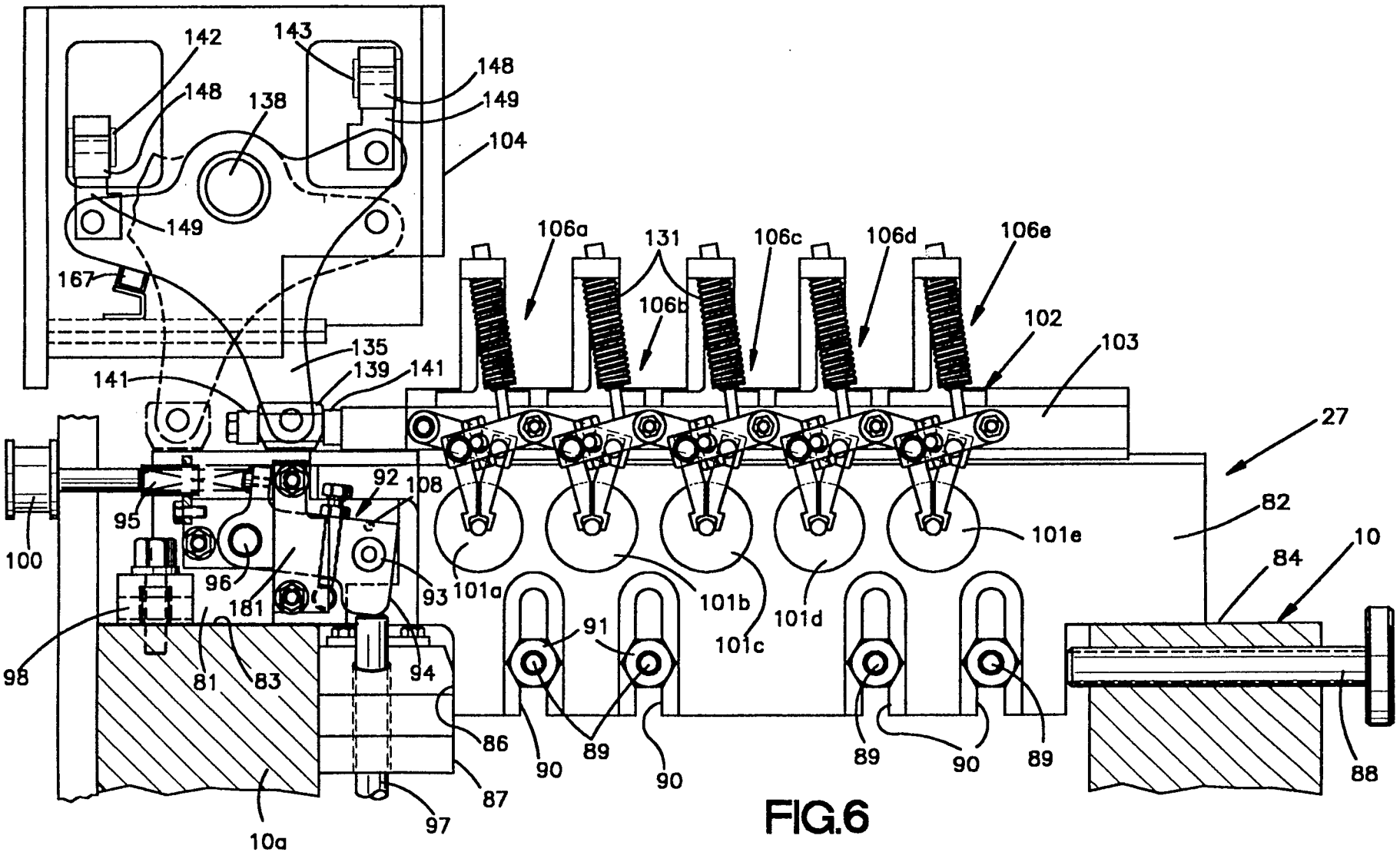
FIG. 6 is a fragmentary section taken generally along line 6—6 of FIG. 2, illustrating the face of the die breast along with the transfer and cutter, with parts removed for purposes of illustration.

Reference should now be made to FIGS. 6 through 11, which illustrate the structural arrangement of the die breast and the transfer system. FIG. 6 is a cross section through the machine illustrating the face of the die breast and the manner in which it is mounted in the frame 10 of the machine. The die breast 27 is provided with extensions 81 and 82 which extend over and rest upon accurately formed positioning surfaces 83 and 84, respectively. These surfaces precisely position the two ends of the die breast in a vertical direction. Lateral positioning of the die breast 27 is provided by engagement between a vertically extending die breast surface 86 adjacent to the wing 81 and a vertical surface 87 accurately formed on a block mounted on the frame 10. A bolt 88 threaded through the frame 10 adjacent to the wing 82 is threaded forward to ensure that the two vertical surfaces 86 and 87 engage to provide the precise lateral positioning of the die breast within the machine. Therefore, if there is any tolerance variation in the spacing between the two sides of the machine frame, it has no effect on the lateral positioning of the die breast within the machine.

Stud bolts 89 are located, in the illustrated embodiment, at four locations across the width of the breast plate 30 and extend forwardly through downwardly open notches 90 in the die breast and face plate 28. Nuts 91 threaded onto the stud bolts 89 operate when tightened to firmly clamp the die breast 27 and face plate 28 against the breast plate 30.

A cutter assembly 92 is mounted on the wing portion 81 of the die breast and operates to shear workpieces from lengths of rod or wire stock fed into the machine by the stock feed assembly 21 (illustrated in FIG. 1). The cutter assembly 92 includes a cutter ring 93 supported by a cutter arm 94 pivoted for oscillating movement on a pivot pin 96. During the operation of the cutter, the cutter ring is moved upwardly from the illustrated position by a camoperated push rod 97 to shear a workpiece from the end of the stock extending into the cutter ring. This produces an upward force on the die breast so a toe clamp 98 is provided to clamp the wing 81 against the surface 83 during the operation of the cutter. A spring 95 loaded by a piston and cylinder actuator 100 resiliently biases the cutter arm 94 toward the push rod 97.

The die breast and cutter assembly, along with the transfer, are easily removed from the machine by merely loosening the nuts 91 and releasing the toe clamp 98. The manner in which the removal occurs is discussed in greater detail below.

As discussed in greater detail in the copending application Ser. No. 190,175, cited above, the slide 29 is provided with guide bearings which laterally locate the slide with respect to the side of the frame 10*a*, which is the same side of the frame that provides the lateral location of the die breast. Therefore, accurate relative lateral positioning of the dies contained in the die breast and the tools carried by the slide is achieved even if manufacturing tolerances or thermal expansion result in variations in the width of the frame.

As mentioned previously, the illustrated machine provides five work stations. Therefore, as best illustrated in FIG. 6, there are five dies 101*a* through 101*e* mounted in the die breast 27 at laterally spaced locations across the face of the die breast. A transfer assembly 102 is provided to sequentially transfer the workpieces cut from the stock by the cutter assembly 92 from the cutter assembly to each of the dies 101*a* through 101*e*. The transfer assembly includes a slide 103 which is mounted on the top of the die breast for reciprocating movement along the length of the die breast. A cam-driven transfer drive linkage 104 is provided to power the slide in such reciprocating movement.

Mounted on the transfer slide 103 are five identical gripper assemblies 106*a* through 106*e*, each of which includes a pair of gripper fingers 107. The gripper fingers are powered between a closed gripping position in which they operate to grip a workpiece for transfer to a subsequent die station and an open position in which the workpiece is released in a manner described in detail below.

In operation, the gripper fingers 107 of the gripper assembly 106*a* move while open to a pick-up position 108 at the cutter assembly 92, where they close and grip a workpiece for transfer to the first work station in front of the die 101*a*. Similarly, the remaining grippers 107 operate to sequentially transfer workpieces to each of the dies 101. The finished workpiece is transferred to a drop position after being sequentially worked at each of the work stations.

Figure 7:
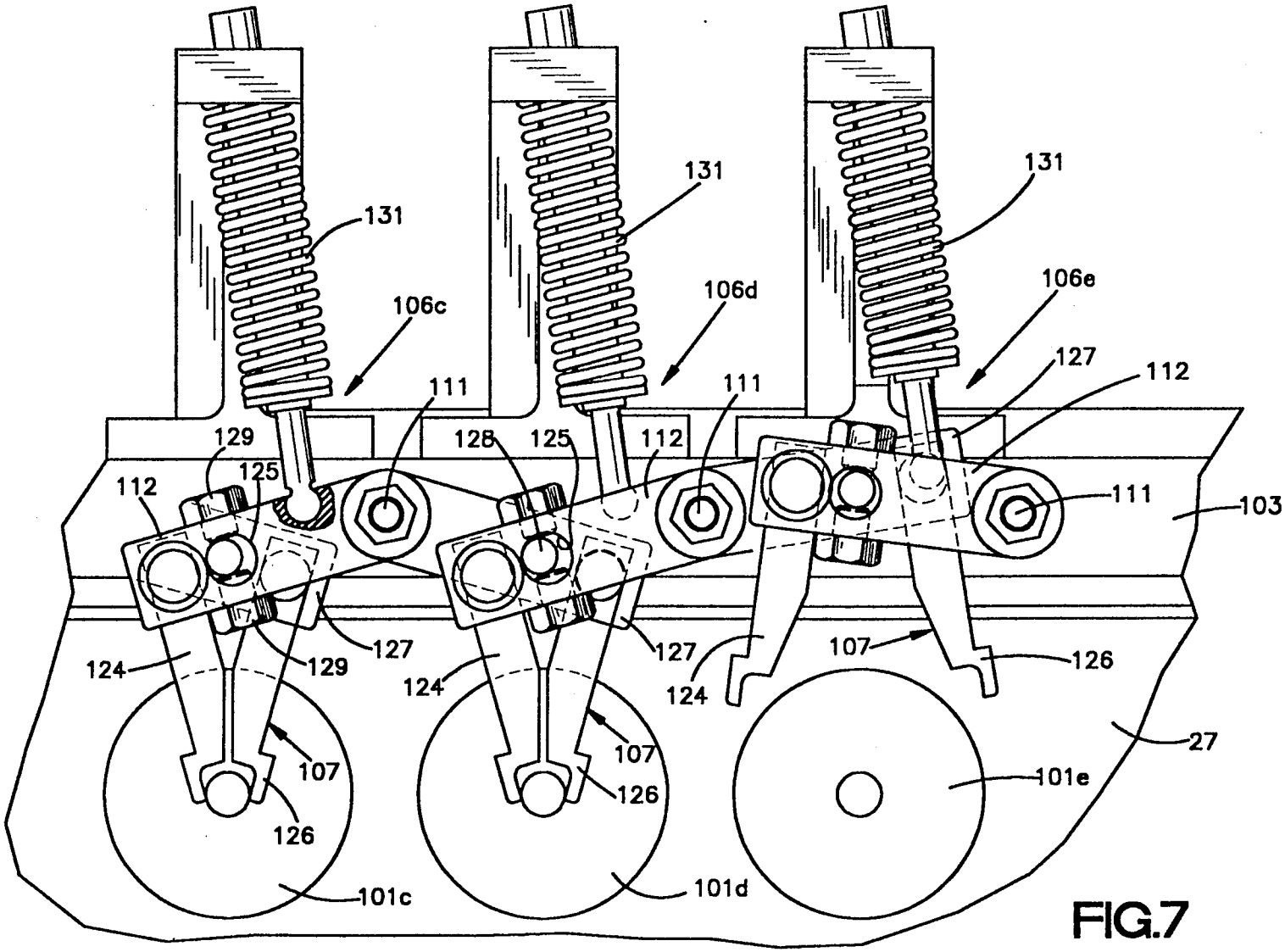
FIG. 7 is an enlarged, fragmentary section, illustrating the linkage system of the transfer grippers in both the open and closed positions.
Figure 8:
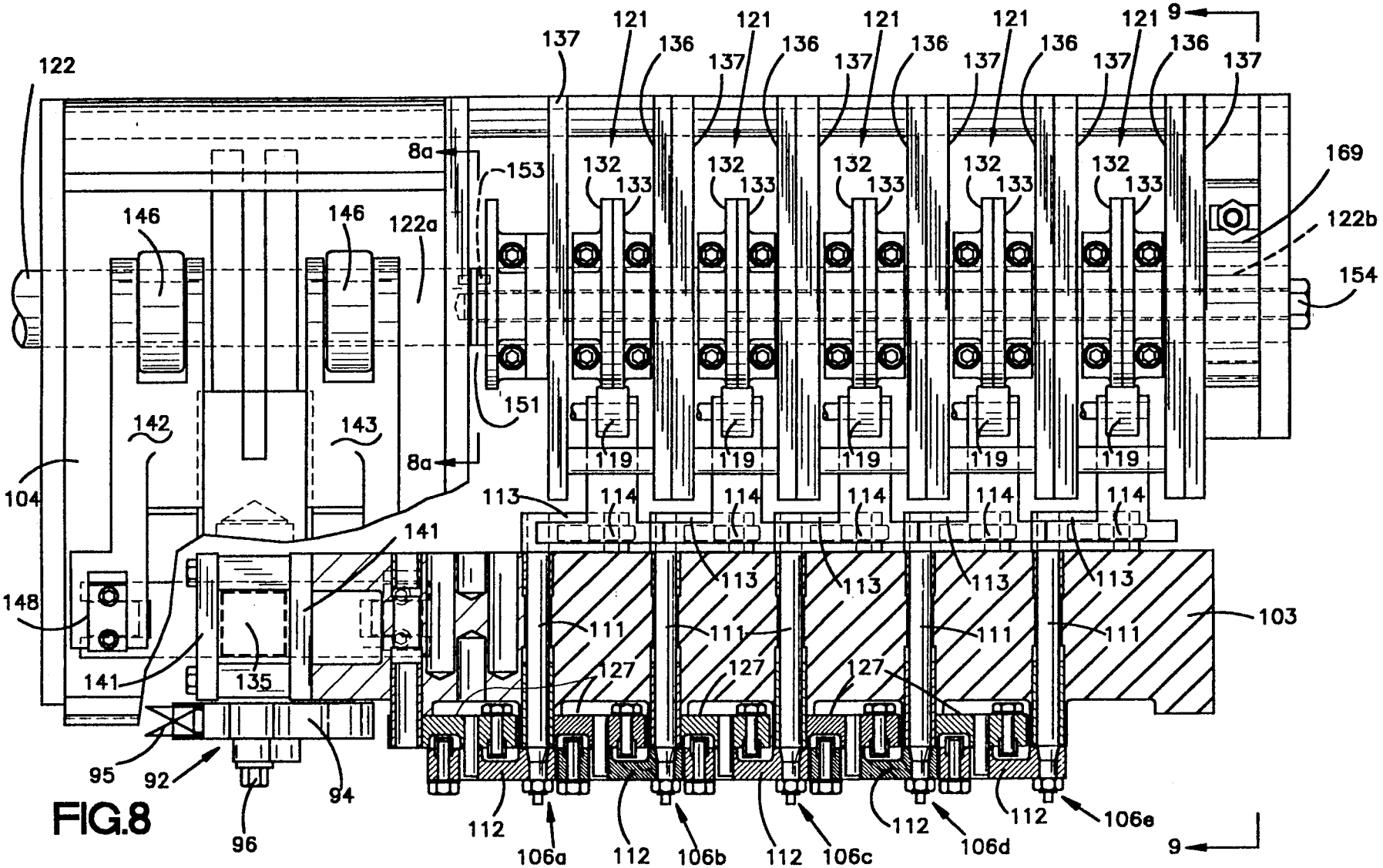
FIG. 8 is a fragmentary section, with parts removed for purposes of illustration, illustrating the cam drive linkage for opening and closing the transfer grippers.
Figure 9:
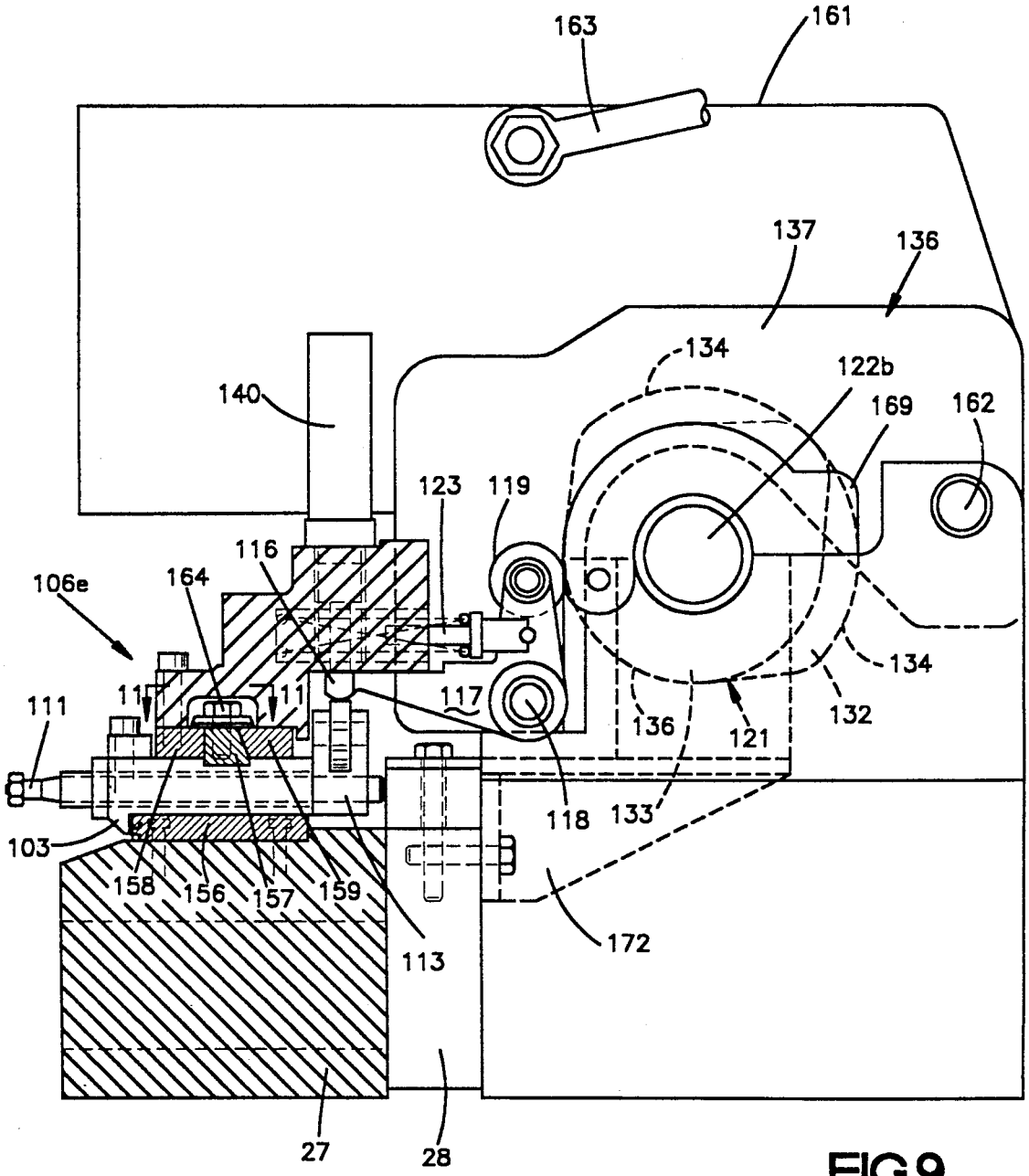
FIG. 9 is a fragmentary section taken generally along line 9—9 of FIG. 8.

Referring to FIGS. 7 through 9, each gripper assembly 106*a* through 106*e* includes a rocker shaft 111 journaled in the transfer slide 103. Mounted on the forward end of each rocker shaft 111 is an arm 112 which is fixed against rotation relative to the associated rocker shaft. Mounted on the rearward end of each rocker shaft is a follower arm 113 carrying a roller follower 114 at its end. The roller follower engages the rail portion 116 of a rocker arm 117 which is journaled for oscillation rotation about a pivot 118. The rocker arm 117 carries a roller follower 119 which engages an associated cam assembly 121 mounted on and rotating with a camshaft 122 powered by the transfer camshaft sprocket 24 (illustrated in FIG. 1). A spring 123 is provided to resiliently bias the follower 119 against the cam assembly 121.

As the camshaft 122 rotates, the cam assembly 121 causes the rocker arm to rotate from the position illustrated in FIG. 9 in an anticlockwise direction, which operates to depress the roller 114 and causes the rotation of the rocker shaft 111 in a clockwise direction as viewed in FIGS. 6 and 7. This causes clockwise rotation of the arm 112 and causes it to move the associated gripper finger 124 of the pair of fingers 107 from the closed position of the gripper assembly 106*c* and 106*d* to an open position of the gripper 106*e*. When the cam assembly allows the rocker arm 117 to return to the position illustrated in FIG. 9, the opposite rotation of the associated rocker shaft 111 occurs, and the finger supported thereby moves to the closed position illustrated in FIG. 7 with respect to the gripper assemblies 106*c* and 106*d*.

The rail portion 116 of the rocker arm 117 extends parallel to the direction of slide movement so the reciprocating movement of the slide merely causes the roller 114 to move back and forth along the associated rail portions 116 and does not affect the opening or closing of the fingers. A somewhat similar linkage system for opening and closing grippers is illustrated in U.S. Pat. No. 3,685,070. However, such linkage system requires component parts which differ at adjacent work stations.

The other gripper finger 126 of each pair of gripper fingers 107 is mounted on the end of an arm 127 journaled for pivotal movement along the axis of the next adjacent rocker shaft. Such arm 127 is connected to the associated arm 112 by a pin 128 which extends through a clearance opening 125 in the associated arm 112 and between a pair of opposed adjusting screws 129. The pin, therefore, interconnects associated arms 112 and 127 so that when an arm 112 is rotated by the cam drive in a clockwise direction, the associated arm 127 rotates in an anticlockwise direction. Therefore, the fingers 124 and 126 open and close in unison. A spring 131 resiliently biases the associated fingers 124 and 126 to the closed position and maintains the roller 114 in contact with the associated rail portion 116 except when gripping blanks.

The opening and closing of the individual fingers can be separately timed by adjustment of the associated cam assembly 121. Each of the cam assemblies 121 includes two cams 132 and 133, which are separately clamped onto the camshaft 122. Each of the cams 132 and 133 has the same diameter along an outer dwell portion 134 and the same diameter along an inner dwell portion 136. Therefore, the stroke of the follower arm, and in turn the amount of rotation of the associated rocker shaft 111, is not changed by the adjustment of the associated cams. However, the point in the machine cycle in which the follower 119 engages the rise portion or the dropping portion of the cam assembly is determined by the adjusted positions of the cams 132 and 133 on the camshaft 122. In operation, the fingers are opened by one of the cams of each pair and are closed by the other of an adjacent pair of cams. Since each cam can be separately adjusted on the camshaft, this permits full adjustment of the opening and closing operation of each transfer subassembly.

As the transfer slide 103 moves back and forth between the pick-up or gripping position and the delivery or release position, the rollers 114 move from the rail portion 116 of one rocker arm 117 to the rail portion of the next adjacent rocker arm 117. Therefore, the rail portions of all of the rocker arms 117 are maintained in direct alignment while the transfer slide causes the rollers to pass over the intersection between adjacent rail portions 116. Therefore, all of the cams are positioned so that the rollers 119 engage one or the other of the dwell portions of the associated cams as the roller passes from one rail portion to the next.

A piston and cylinder actuator 140 is provided for each rocker arm 117. When pressurized, the actuator depresses the associated rail portion 116 to prevent the associated gripper from closing. This allows the dropping or rejecting of workpieces.

As best illustrated in FIG. 8, the transfer consists of a plurality of identical modules 136, with one module provided for each work station. Therefore, in a five-station machine, five identical modules are bolted together to form a transfer assembly.

Each module includes a frame assembly 137, a rocker arm 117, and an actuator 140. In instances in which a machine is produced having a lesser number of work stations, for example, three work stations, three modules are bolted together to provide a transfer assembly. Because these modules are identical within a given size of machine, it is practical to produce the modules for inventory and then assemble the modules as required for the particular machine being fabricated. This results in production economies and reduces the lead time necessary to produce a given machine.

Further, since all of the cam assemblies 121 are identical, the cams can be produced for inventory and the proper number of cam assemblies corresponding to the number of work stations on the machine being fabricated are merely assembled on a camshaft 122. Similarly, each of the rocker shafts 111 and associated grippers and follower arms are identical subassemblies, and such subassemblies are installed so that one is provided for each work station.

Further, the transfer drive linkage 104 is identical for all machines of a given size, regardless of the number of work stations provided.

Figure 10:
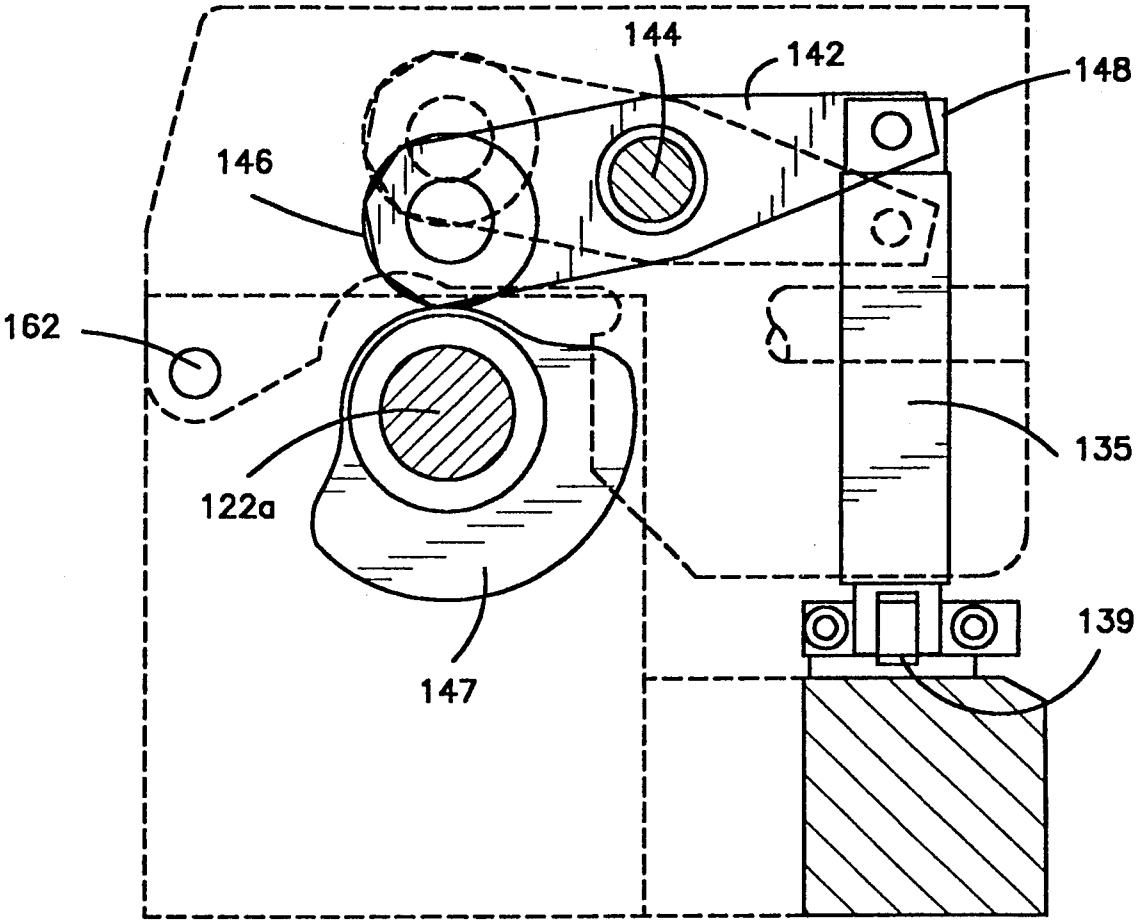
FIG. 10 is a fragmentary section, illustrating the transfer drive linkage.

The structure and operation of the transfer drive linkage 104 is best illustrated by referring to FIGS. 6, 8, and 10. Such linkage includes a generally T-shaped rocker arm 135, best illustrated in FIG. 6, which is journaled for pivotal movement on a pivot 138 and supports at its lower end a drive block 139 positioned between a pair of plate members 141 bolted on the end of the transfer slide 103. Therefore, when the rocker arm 135 oscillates between the full-line position of FIG. 6 and the phantom-line position of FIG. 6, the transfer slide reciprocates between its gripping or pick-up position and its delivery or release position.

The rocker arm 135 is driven by a pair of similar follower arms 142 and 143 illustrated in FIGS. 8 and 10, which are journaled on pivots 144 for oscillating rotation about a pivot axis parallel to the axis of the camshaft 122. Each of these follower arms provides a roller follower 146 which engages an associated cam 147. The cams are matched and shaped so that as the follower arm 142 moves in one direction, the follower arm 143 moves in the opposite direction. Pivoted on the end of each follower arm 142 and 143 opposite the associated rollers 146 is a hardened bearing block 148 which engages a hardened block 149 pivoted on the opposed arms of the rocker arm 135. As the cams rotate, they move the rocker arm 135 back and forth to produce the reciprocating movement of the slide 103.

Figure 8A:
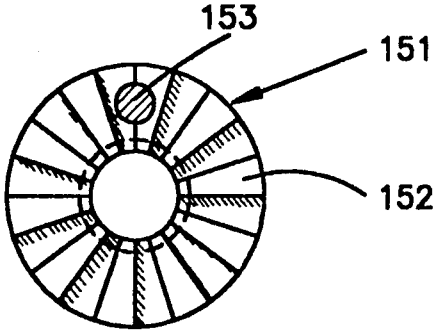
FIG. 8*a* is a fragmentary view taken along line 8*a*—8*a* of FIG. 8, illustrating the transfer camshaft coupling.

The camshaft 122 is formed of two shaft portions **122*a* and 122*b*, which are connected for rotation as a unit by a releasable connection or coupling 151. This coupling includes an opposed face spline 150 formed on the adjacent ends of the two shaft portions 122*a* and 122*b*, which provide interfitting, radially extending teeth 152 (see FIG. 8*a*). The teeth interfit to provide a driving connection between the two shaft portions 122*a* and 122*b***.

The coupling 151 also provides an indexing pin 153 mounted on the shaft portion **122*a* which projects into a mating bore on the shaft portion 122*b* when the two shaft portions are rotationally oriented relative to each other in the proper position. A tie bolt 154 extends through the shaft portion 122*b* and threads into the adjacent end of the shaft portion 122*a*** to lock the face cams in locking engagement.

When it is desired to disconnect the two shaft portions **122*a* and 122*b*, it is merely necessary to release the tie bolt 154 and slide the shaft portion 122 to the right, as illustrated in FIG. 8, to release the connection between the two shaft portions. When reconnection is required, the shaft portion 122*b* is rotated until the indexing pin registers with the mating bore and the shaft portion is then moved to the left, as viewed in FIG. 8**, and the tie bolt is tightened.

Since the cam assemblies 121 are adjusted to provide the particular timing of the gripper fingers, the shaft portion **122*b*, which carries the cam assemblies 121, is removable from the machine along with the die breast and the transfer slide 103. Therefore, when a tool set is reinstalled, it is not necessary to readjust the transfer assembly and operation of the machine can be commenced without any readjustment of the cam assemblies 121**.

The operation of changing individual dies or removing an entire die set is best illustrated by referring to FIGS. 9, **9*a*, and 9*b*. FIG. 9 illustrates the machine in its operative condition. In such condition, the transfer slide is supported by a bearing plate 156 bolted on the die breast 27 for its reciprocation between the pick-up and delivery positions. Mounted on the top of the transfer slide is a key 157 which cooperates with a pair of guide bearings 158 and 159 carried by the transfer frame to guide the transfer slide 103 in its reciprocating movement. The entire transfer housing assembly 161 is mounted on a pivot shaft 162 so that it can be moved from the operative position to a raised or retracted position when die changes are required. A piston and cylinder actuator 163** is connected to power the transfer housing between its raised or retracted position and its lowered or operative position.

In some instances, it is desired to raise the transfer assembly with the housing so that access can be provided to the face of the dies. This is required when, for example, a single die must be changed because it is worn. In other instances, it is desirable to remove the adjusted components of the transfer with the die breast, as when an entire tool set change is to be performed.

Figure 11:
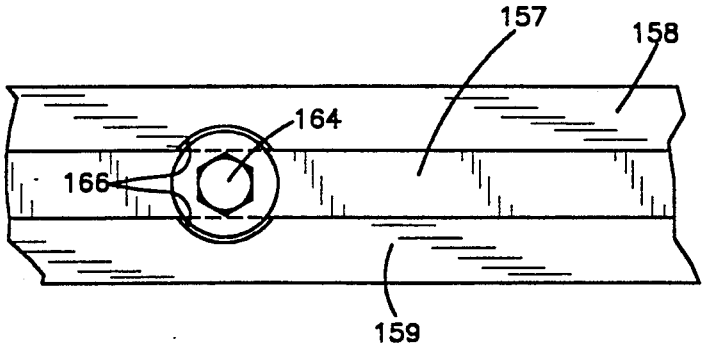
FIG. 11 is a fragmentary view, taken along line 11—11 of FIG. 9, illustrating the connecting structure which permits the transfer to be selectively lifted away from the die breast or allowed to remain with the die breast.

As best illustrated in FIGS. 9 and 11, a bolt 164 is threaded into the key 157 and moves back and forth with the transfer slide as it reciprocates. The head of the bolt 164 extends over the two guide bearings 158 and 159 in all positions of the transfer slide except one, and in such position, the bolt head is positioned over a pair of clearance notches 166 formed in the guide bearings 158 and 159. In such one position, the head of the bolt 164 passes through the notches 166 when the guide bearings 158 and 159 are raised with the housing 161 and the transfer slide remains on the die breast. Except in that position, however, when the transfer housing 161 is pivoted up to its raised position, the head of the bolt 164 engages the upper surface of the two guide bearings 158 and 159 and operates to raise the transfer slide with the housing.

FIG. **9*a* indicates the position of the various components of the system when access to the dies within the die breast is required without removing the die breast from its mounted position. Such access is provided by merely stopping the machine in a position in which the bolt 164 is spaced from the notches 168. When the machine is stopped in such position, and the actuator 163 is operated to pivot the transfer housing 161 up clear of the die breast, the slide 103 and grippers are carried up with the housing 161. Such pivotal movement also causes the rocker arms 117 and the drive linkage 104** to be raised up clear of the die breast. This simple operation of raising the transfer housing can be performed very quickly and provides full access to the dies for the servicing of any particular die that needs to be replaced or repaired.

In other instances, when an entire tool change is required, the machine is stopped in its delivery position, in which the bolt 164 is aligned with the notches 166 in the guide bearings 158 and 159. In such position, when the housing 161 is pivoted up to its raised position by the actuator 163, the transfer remains in place on the die breast 27. However, the rocker arms 117 of the transfer drive linkage are raised with the transfer housing. In such position, the rocker arm 135 is in the full-line position of FIG. 6 and the drive block 139 is lifted up clear of the two plate members 141. This provides an automatic disconnection between the reciprocating drive linkage 104 and the slide.

Figure 9A:
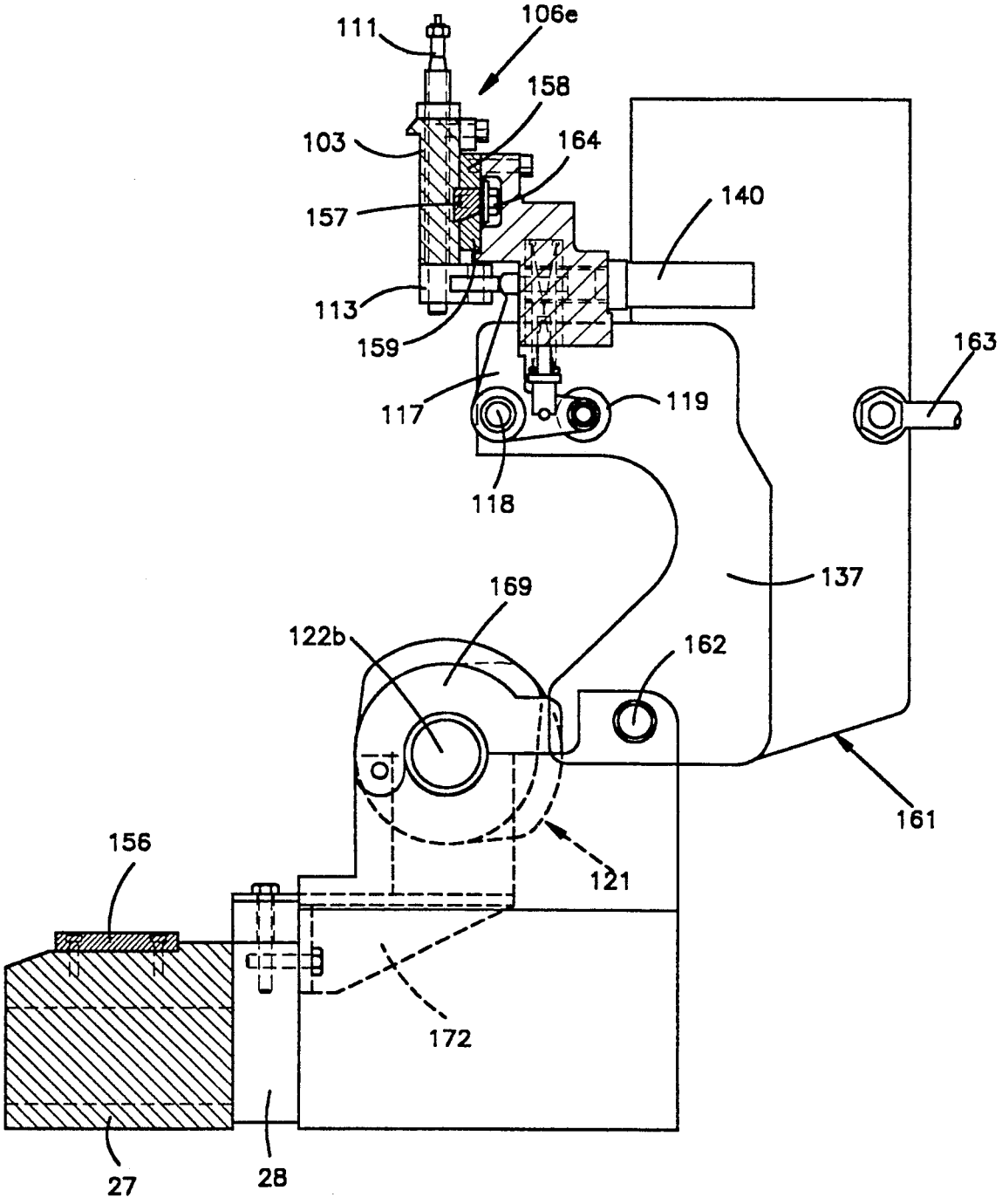
FIG. 9*a* is a fragmentary view similar to FIG. 9, but showing the transfer housing in its raised or retracted position to provide access to the dies within the die breast.
Figure 9B:
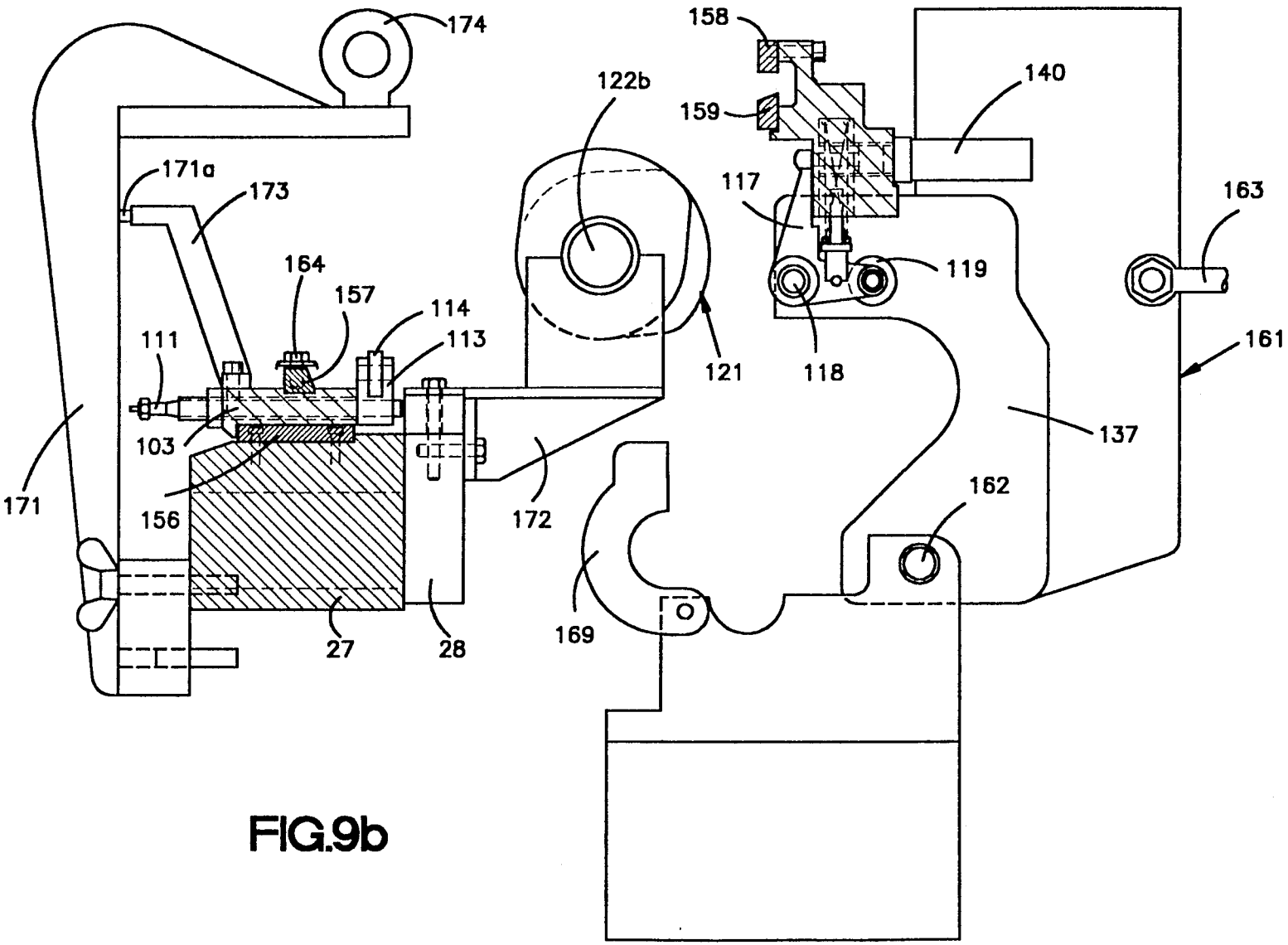
FIG. 9*b* is a fragmentary view similar to FIG. 9, illustrating the removal of the die set and transfer during a tooling change.

In order to ensure that the rocker arm 137 remains in such position until it is reconnected to a transfer slide 103, a magnet 167, illustrated in FIG. 6, is provided within the housing to hold the rocker arm 137 in the full-line position of FIG. 6. The entire die breast and the transfer slide 103, along with the camshaft portion **122*b*, can then be removed from the machine as a unit, as best illustrated in FIG. 9*b***.

Before removing the die breast, the tie bolt 154 is released and the camshaft portion **122*b* is moved laterally to the right (as viewed in FIG. 8) to release the coupling 151. Also, a bearing block 169 is released and tipped up to release the other end of the camshaft portion 122*b*. A lifting jig 171 is connected to the die breast 27** to lift the entire die breast and most of the transfer out of the machine.

Mounted on the rearward side of the face plate 28 is a cradle 172 which fits up under the camshaft portion **122*b* with a small clearance during normal operation. This cradle operates to lift the camshaft portion 122*b*, with the cams mounted thereon, out of the machine when the die breast is removed. Further, the fixture 171 is provided with a restraining finger 171*a* which fits between the spring towers 173 when the fixture 171 is installed to hold the transfer slide in position on the die breast 27. A hoist connected to the lift ring 174 of the fixture 171 is used to raise the die breast 27, face plate 28, the transfer slide 103, and camshaft portion 122*d* up out of the machine, as illustrated in FIG. 9*b***.

As best illustrated in FIG. 2, the breast plate 30 is provided with upwardly open notches 191, through which the kickout pins for the dies extend. These notches 190 are sized so that the rearward ends of the kickout pins 190 which are removed with the dies are located within the notch 191. The kickout rods 192, however, remain in the machine. Therefore, when the die breast is removed, the kickout pins 190 which extend into the dies can be removed with the die breast, regardless of the position of the kickout rods 192.

Since all of the adjustable elements of the transfer are removed as a single unit from the machine along with the die breast, the fine-tuning of the transfer adjustment is not disturbed in any way during the removal of the entire tool set from the machine. Consequently, when it is necessary to reinstall such tool set in the machine, the entire assembly is reinstalled and, typically, further running adjustment of the tooling and of the transfer is not required.

It should be noted, however, that when the die breast and camshaft portion **122*b* are removed, the camshaft portion 122*a* remains in the machine. Since the cams carried by the camshaft portion 122*a* are not adjusted for a particular job, but rather for the basic timing of the machine, which remains constant, there is no need to remove the camshaft portion 122*a*** when a complete tool changeover is made.

Before removing the die breast, however, it is necessary to release the toe clamp 98 and to retract the piston and cylinder actuator 100 which loads the spring 95 of the cutter. Since the cutter assembly 92 is carried by the die breast, it is also removed when the die breast is removed for a tool changeover. Such cutter, however, may be separately removed by merely removing a plate 181 and retracting the piston and cylinder actuator 100 when, for example, a cutter ring must be replaced.

With this invention, it is possible to quickly perform an entire tool changeover. For example, the slide tooling is easily removed by merely loosening four nuts, and when removed, all of the fine-tuning adjustment of the slide tooling is maintained. Similarly, the die breast, with the dies located therein, can be easily and quickly removed along with all of the portions of the transfer which are adjusted for a particular tool set. Here again, readjustment of the dies and the transfer is not required when the tool set is replaced in the machine.

Further, the release and reclamping of the components do not require removal of any bolts or nuts. Therefore, the person making a tool change does not have to replace any separate elements when installing a set of tools. Preferably, all of the clamping bolts and nuts require only one or, at most, two wrench sizes. This permits an entire tool change with a minimum number of hand tools.

Further, to a great extent, individual elements of the machine and various assemblies of the machine are identical for a given machine size so that substantial numbers of component parts of the machine can be manufactured by economical production runs. Then, when a given machine having a given number of work stations must be built, substantial numbers of the components of the machine can be merely assembled from inventory and lead times are reduced.

With the present invention, it is possible to complete a change of all of the tooling in less than 20 minutes, so that a given machine can be converted from one job to another without significant loss of the production capacity of the machine. Typically, all of the tooling, including the transfer, is initially set up on fixtures for installation in the machine as units. During the initial installation of the tooling on the machine, it is often necessary to make fine-tuning adjustment of the tooling. However, after the tooling set is fine-tuned, its subsequent removal is accomplished without affecting any of the fine-tuned adjustment. Consequently, when such tooling is then reinstalled in the machine, production can normally be commenced immediately. This is compared with many conventional machines in which a tool changeover takes many hours before production can be commenced.

Further, because modular construction is provided to a substantial extent, production economies can be realized by producing a number of elements and component assemblies for inventory. Because many of the components and subassemblies are modularized for a given machine size, and are assembled in appropriate numbers in a given machine having a given number of work stations, it is practical to manufacture for inventory and to assemble required machines with reduced lead time.

Although the preferred embodiment of this invention has been shown and described, it should be understood that various modifications and rearrangements of the parts may be resorted to without departing from the scope of the invention as disclosed and claimed herein.

What is claimed is:

1. A method of providing progressive formers having a frame and reciprocating slide with quick-change tooling comprising providing a plurality of tooling sets each including:

(a) a die breast with a plurality of dies therein for mounting on said frame;

(b) a transfer assembly including transfer fingers for progressively transferring workpieces to said dies and which includes transfer adjusting means for adjusting operation of said transfer fingers;

(c) a separate tool assembly for mounting on said slide providing tools operable in cooperation with each die to progressively form said workpieces, said tool assembly including second adjustable means for adjusting the position of said tools with respect to said dies in all directions;

(d) adjusting said transfer adjusting means and said second adjusting means while said die breast, transfer assembly, and tool assembly are in said machine to fine-tune said tool set; and (e) removing and reinstalling said die breast, said transfer assembly and said tooling assembly without changing said adjustment of said transfer and said tool assembly whereby fine-tuning of said adjustments performed prior to removal of a tool set is retained when said tool set is reinstalled so that reinstalled tooling sets may be used without further substantial fine-tuning.

2. A method as set forth in claim 1, including providing said second adjustable means with an adjustable wedge for adjusting said tooling toward and away from said dies, and removing said wedge with said tools as a unit without changing the adjustment of said wedge.

3. A method as set forth in claim 1, including providing said formers with a frame and a reciprocating slide on said frame, providing mating locating surfaces on said frame and said die breast for locating said die breast relative to said frame in a predetermined position, and providing additional locating surfaces on said tool assembly and said slide establishing a predetermined position of said tool assembly relative to said slide.

4. A method as set forth in claim 2, including providing threaded fasteners for locking said die breast and said tool assembly in said predetermined positions, and mounting said fasteners to permit release of said die breast and said tool assembly without removing said fasteners.

* * * * *